US009048542B2

(12) United States Patent
Han et al.

(10) Patent No.: US 9,048,542 B2
(45) Date of Patent: Jun. 2, 2015

(54) SIDE-FACE RADIATION ANTENNA AND WIRELESS COMMUNICATION MODULE

(71) Applicant: SAMSUNG ELECTRO-MECHANICS CO., LTD., Suwon (KR)

(72) Inventors: Myeong Woo Han, Suwon Gyeonggi-do (KR); Jung Aun Lee, Suwon Gyeonggi-do (KR); Nam Heung Kim, Suwon Gyeonggi-do (KR)

(73) Assignee: SAMSUNG ELECTRO-MECHANICS CO., LTD., Suwon, Gyunggi-do (KR)

( * ) Notice: Subject to any disclaimer, the term of this patent is extended or adjusted under 35 U.S.C. 154(b) by 349 days.

(21) Appl. No.: 13/730,263

(22) Filed: Dec. 28, 2012

(65) Prior Publication Data

US 2013/0207869 A1 Aug. 15, 2013

(30) Foreign Application Priority Data

Dec. 28, 2011 (KR) ..... 10-2011-0144819

(51) Int. Cl.

| | |
|---|---|
| ***H01Q 1/38*** | (2006.01) |
| ***H01Q 1/36*** | (2006.01) |
| ***H01Q 1/48*** | (2006.01) |
| ***H01Q 9/04*** | (2006.01) |
| ***H01Q 9/36*** | (2006.01) |

(52) U.S. Cl.
CPC . *H01Q 1/36* (2013.01); *H01Q 1/48* (2013.01); *H01Q 9/0407* (2013.01); *H01Q 9/36* (2013.01)

(58) Field of Classification Search
CPC ..... H01Q 9/0407; H01Q 9/36; H01Q 1/48
USPC ..... 343/700 MS, 702, 848
See application file for complete search history.

(56) References Cited

U.S. PATENT DOCUMENTS

| | | | | |
|---|---|---|---|---|
| 6,975,276 | B2 | 12/2005 | Brown | |
| 7,183,976 | B2 | 2/2007 | Wu et al. | |
| 2011/0248891 | A1 * | 10/2011 | Han et al. | 343/700 MS |
| 2012/0162015 | A1 * | 6/2012 | Chen et al. | 343/700 MS |
| 2013/0088396 | A1 * | 4/2013 | Han | 343/700 MS |

* cited by examiner

*Primary Examiner* — Hoang V Nguyen
(74) *Attorney, Agent, or Firm* — McDermott Will & Emery LLP

(57) ABSTRACT

Disclosed herein are a side-face radiation antenna and a wireless communication module. According to an embodiment of the present invention, there is provided the side-face radiation antenna including a via patch part formed at a side portion of a module substrate including laminated substrates to perform a side-face radiation, and formed by metal filled in a plurality of vias arranged at a predetermined interval in the side portion and connected, and a feed line part inserted between intermediate layers of the module substrate, and connected to the via at a center portion of the via patch part. In addition, there is provided the wireless communication module including the side-face radiation antenna.

20 Claims, 5 Drawing Sheets

SIDE-FACE RADIATION ANTENNA AND WIRELESS COMMUNICATION MODULE

CROSS REFERENCE(S) TO RELATED APPLICATIONS

This application claims the benefit under 35 U.S.C. Section 119 of Korean Patent Application Serial No. 10-2011-0144819, entitled "Side-face Radiation Antenna and Wireless Communication Module" filed on Dec. 28, 2011, which is hereby incorporated by reference in its entirety into this application.

BACKGROUND OF THE INVENTION

1. Technical Field

The present invention relates to a side-face radiation antenna and a wireless communication module, and more particularly, to a side-face radiation antenna that is formed by connecting, using a metal, a plurality of vias formed in an inner side of a module substrate, and a wireless communication module.

2. Description of the Related Art

In an antenna structure of wireless transmission products of images, data, and the like in mm-wave band, for example, a digital television (TV), a Blu-ray system, a notebook PC, a desktop PC, and the like, front-face radiation has been usually used.

In portable communication devices, a planar dipole antenna, a monopole antenna, a planar patch antenna, and the like are widely used.

The planar dipole antenna has advantages of being easily manufactured, and enabling applications to a variety of structures. In addition, a bandwidth of the planar dipole antenna may be increased by increasing a width of a dipole arm and a space between a dipole and a reflection ground surface, however, there are disadvantages in that an impedance of each of the dipole arms is greatly changed when the bandwidth is increased, while a size of the antenna is increased.

Meanwhile, the monopole antenna is most commonly used in a wireless mobile antenna, a transmission antenna of a radio broadcast, or the like. The monopole antenna has a narrow bandwidth, so that there is an advantage in that a size of the antenna is increased to improve a bandwidth thereof.

Next, the planar patch antenna may be easily manufactured, and facilitate matching by adjusting an inset position. However, a surface wave and parasitic feeding radiation are increased along with an increase in a thickness of a substrate, so that there is a limitation in a bandwidth of the planar patch antenna in an actual design. In addition, since the planar patch antenna has a front-face radiation structure, a size of the antenna is still relatively large when the planar patch antenna is used in portable mobile devices.

The front-face radiation antenna structure that is widely used in wireless transmission of voice, images, data, and the like in the mm-wave band is not sufficient to satisfy characteristics concerning a small size of a portable mobile device when being applied to the portable mobile device, for example, a smart phone, a tablet PC, and the like.

SUMMARY OF THE INVENTION

An object of the present invention is to provide an antenna having a side-face radiation structure which may achieve miniaturization and convenience so as to be applied to portable mobile devices.

According to an exemplary embodiment of the present invention, there is provided a side-face radiation antenna, including: a via patch part formed at a side portion of a module substrate including laminated substrates to perform side-face radiation, and formed by metal filled in a plurality of vias arranged at a predetermined interval in the side portion and connected; and a feed line part inserted between intermediate layers of the module substrate, and connected to the via at a center portion of the via patch part.

Here, the side-face radiation antenna may further include a strip part formed in a strip shape, and formed in an upper side and a lower side of the plurality of vias of the via patch part to mutually connect the metal filled in the via.

Further, a space (Sp) between the centers of the plurality of vias of the via patch part may have a relationship of $S_p<0.1\lambda_g$. Here, $\lambda_g$ denotes a wavelength in a dielectric of the module substrate.

Also, a length (L) of each of the plurality of vias of the via patch part may be determined in accordance with a formula on the basis of a length of a patch of a patch antenna.

Furthermore, the length (L) of each of the plurality of vias of the via patch part may be determined by $$L = \frac{c}{2f\sqrt{e_f}}.$$

Here, c denotes the velocity of light in a free space, f denotes a resonance frequency, and ef denotes an effective dielectric constant of the module substrate.

Here, the side-face radiation antenna may further include a ground part respectively formed at an upper side and a lower side of the module substrate while being spaced apart from the via patch part and formed between layers of the module substrate or an upper side or a lower side of the layers of the module substrate, except for between the intermediate layers of the module substrate in which the feed line part is formed.

Further, the ground part may be respectively formed in an upper side and a lower side with respect to the feed line part, a ground in the upper side or the lower side or grounds in the upper and lower sides with respect to the feed line part includes a plurality of ground layers, and the plurality of ground layers may be connected to the metal through vias formed on the substrate between the layers.

Also, the outermost layers of the ground part may be spaced apart from each other in a vertical direction while the via patch part and a substrate layer being interposed therebetween.

Furthermore, the side-face radiation antenna may exhibit characteristics of a planar patch antenna.

Also, the side-face radiation antenna may be an mm-wave band antenna.

According to an exemplary embodiment of the present invention, there is provided a wireless communication module, including: a module substrate formed such that a plurality of substrates are laminated; a wireless communication chip is mounted in the module substrate; and a side-face radiation antenna according to the above described first embodiment, which is formed in the module substrate.

Here, an end of a feed line part of the side-face radiation antenna may be electrically connected with the wireless communication chip.

Further, the wireless communication module may be an mm-wave band communication module.

In addition, the wireless communication module may be used in a portable mobile device.

DESCRIPTION OF THE PREFERRED EMBODIMENTS

Figure 1:
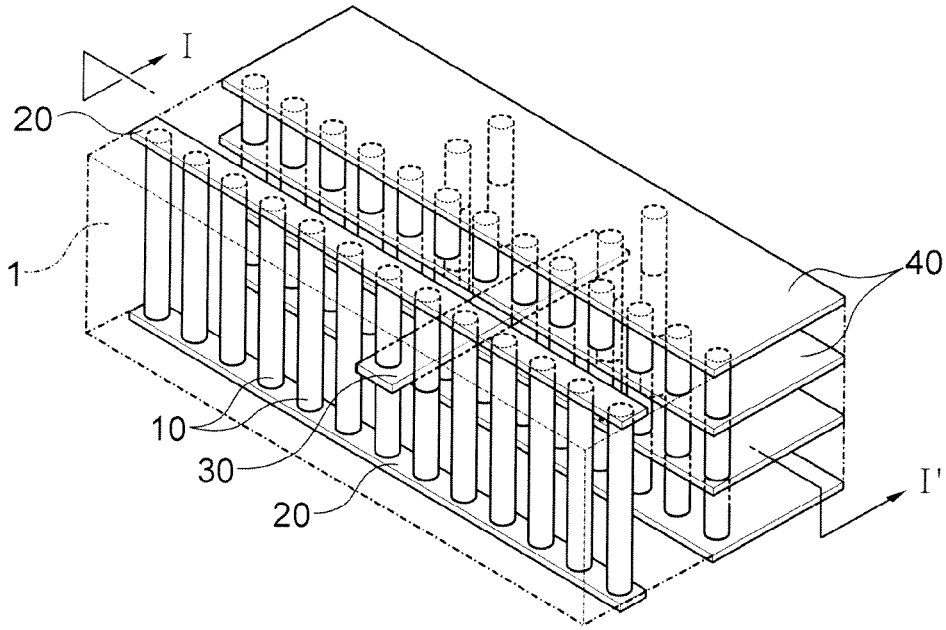
FIG. 1 is a schematic view illustrating a side-face radiation antenna according to an exemplary embodiment of the present invention.

Exemplary embodiments of the present invention for accomplishing the above-mentioned objects will be described with reference to the accompanying drawings. In describing exemplary embodiments of the present invention, the same reference numerals will be used to describe the same components and an additional description that is overlapped or allow the meaning of the present invention to be restrictively interpreted will be omitted.

In the specification, it will be understood that unless a term such as 'directly' is not used in a connection, coupling, or disposition relationship between one component and another component, one component may be 'directly connected to', 'directly coupled to' or 'directly disposed to' another element or be connected to, coupled to, or disposed to another element, having the other element intervening therebetween. In addition, this may also be applied to terms including the meaning of contact such as 'on', 'above', 'below', 'under', or the like. In the case in which a standard element is upset or is changed in a direction, terms related to a direction may be interpreted to including a relative direction concept.

Although a singular form is used in the present description, it may include a plural form as long as it is opposite to the concept of the present invention and is not contradictory in view of interpretation or is used as clearly different meaning. It should be understood that "include", "have", "comprise", "be configured to include", and the like, used in the present description do not exclude presence or addition of one or more other characteristic, component, or a combination thereof.

First, a side-face radiation antenna according to a first embodiment of the present invention will be described in detail with reference to the accompanying drawings. In this instance, a reference numeral that is not described in the drawings may be a reference numeral having the same configuration shown in other drawings.

Figure 2:
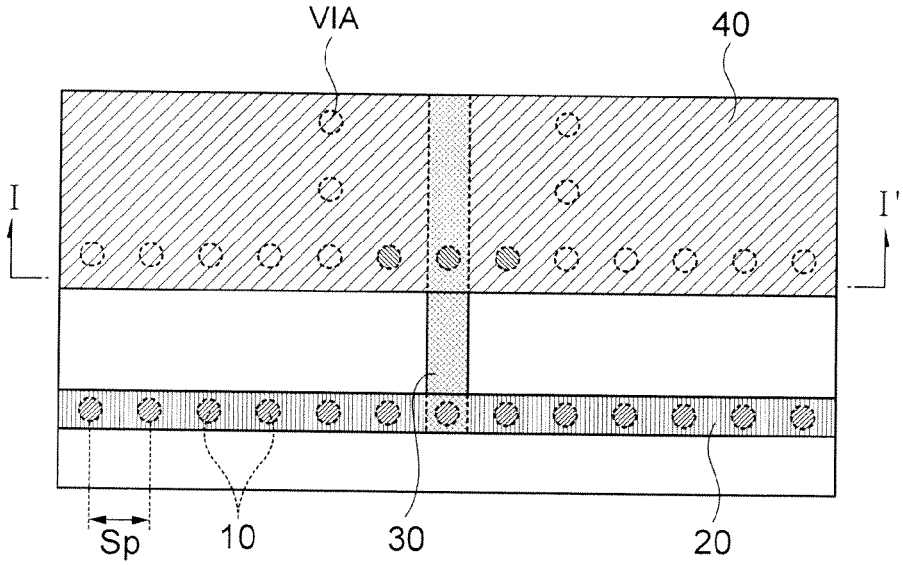
FIG. 2 is a plan view illustrating the side-face radiation antenna of FIG. 1.
Figure 3:
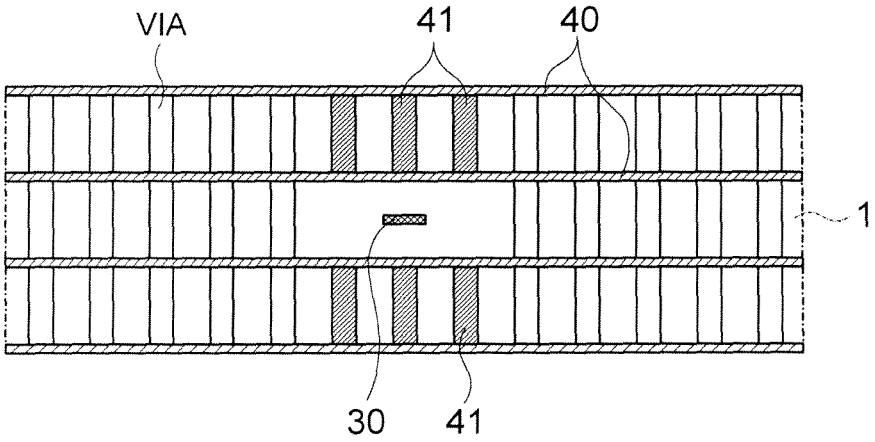
FIG. 3 is a cross-sectional view illustrating a state in which the side-face radiation antenna of FIG. 1 is cut in an I-I' direction.
Figure 4:
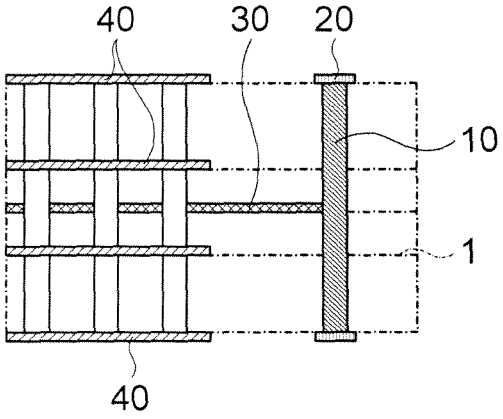
FIG. 4 is a side view illustrating the side-face radiation antenna of FIG. 1.
Figure 5A:
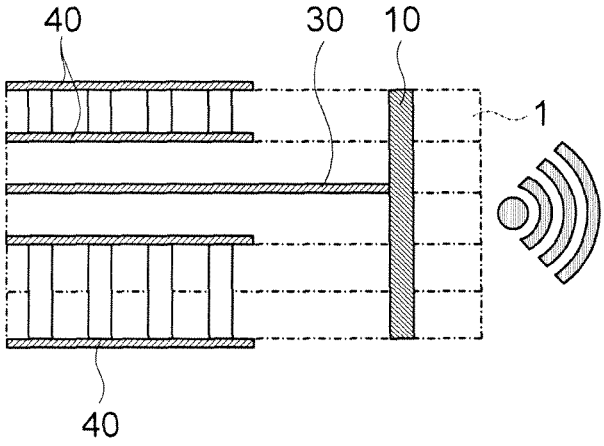
FIGS. 5A and 5B are side views illustrating a side-face radiation antenna according to another exemplary embodiment of the present invention.
Figure 5B:
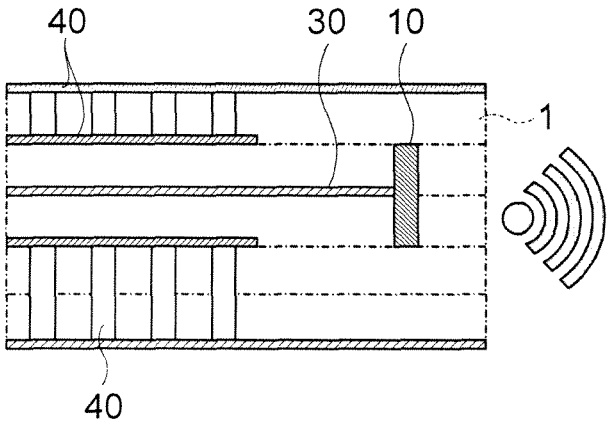
Figure 7A:
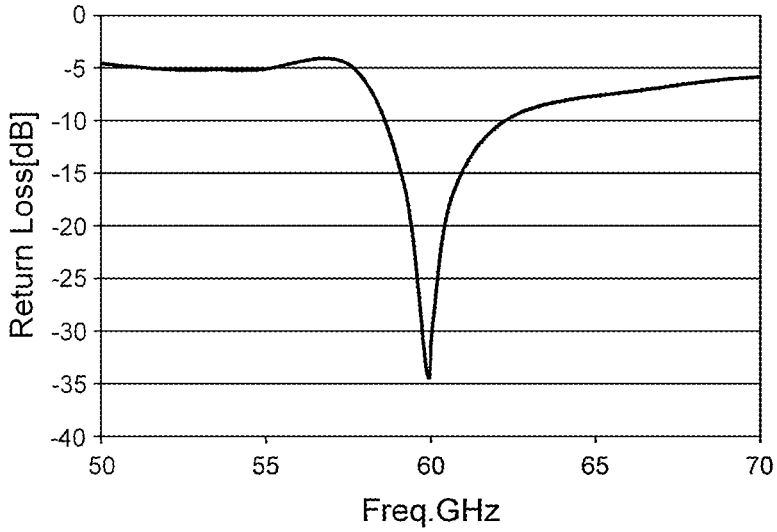
FIGS. 7A and 7B are views illustrating a reflection coefficient and a radiation pattern of a side-face radiation antenna according to an exemplary embodiment of the present invention.
Figure 7B:
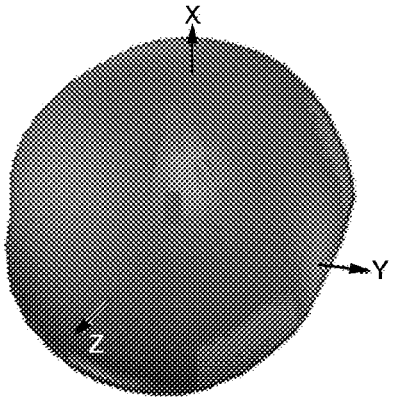

FIG. 1 is a schematic view illustrating a side-face radiation antenna according to an exemplary embodiment of the present invention, FIG. 2 is a plan view illustrating the side-face radiation antenna of FIG. 1, FIG. 3 is a cross-sectional view illustrating a state in which the side-face radiation antenna of FIG. 1 is cut in an I-I' direction, FIG. 4 is a side view illustrating the side-face radiation antenna of FIG. 1, FIGS. 5A and 5B are side views illustrating a side-face radiation antenna according to another exemplary embodiment of the present invention, and FIGS. 7A and 7B are views illustrating a reflection coefficient and a radiation pattern of a side-face radiation antenna according to an exemplary embodiment of the present invention.

Referring to FIGS. 1 through 5B, the side-face radiation antenna according to the first embodiment will be described.

Referring to FIGS. 1, 2, 4, 5A and/or 5B, the side-face radiation antenna may include a via patch part 10 and a feed line part 30. In addition, as shown in FIG. 1 and/or FIG. 2, the side-face radiation antenna may further a strip part 20, and may further include a ground part 40 shown in FIGS. 1, 2, 4, 5A and/or 5B.

In an example, the side-face radiation antenna may exhibit characteristics of a planar patch antenna.

In addition, in an example, the side-face radiation antenna may be an mm-wave band antenna. In an ultra-high frequency such as an mm-wave, since a space between vias looks like a metal surface when being maintained to some extent, operation characteristics such as in the planar patch antenna may be obtained when a plurality of vias are formed in an inner side of a module substrate 1 as shown in FIGS. 1 and 2, and is connected using a metal.

In addition, in an mm-wave band communication device, an electrical connection distance between an antenna and a wireless communication chip (see, reference numeral 3 of FIG. 6) may be implemented as short as possible, thereby improving an electrical loss.

In addition, in the present embodiment, the side-face radiation antenna may be used in portable mobile devices.

Referring to FIGS. 1 and 2, the via patch part 10 is formed at a side portion of the module substrate 1 including laminated substrates 1. The via patch part 10 is formed at the side portion of the module substrate 1 to perform a side-face radiation.

In this instance, the via patch part 10 is formed such that a metal filled in the plurality of vias arranged at a predetermined interval is connected to a side portion. In the ultra-high frequency such as mm-wave, since a space between vias looks like a metal surface when being maintained to some extent, operation characteristics such as in the planar patch antenna may be obtained by forming the via patch part 10 according to the present embodiment.

The planar patch antenna in the related art forms a metal surface at an upper side of the substrate to perform front-face radiation, however, the structure according to the present embodiment is a structure in which side-face radiation is performed using the plurality of vias. In this instance, in order to maintain the side-face radiation structure, a space (Sp) between the vias may be maintained within a predetermined range.

In the above described configuration, the side-face radiation antenna according to the present embodiment may implement a small antenna in a structure of using an empty space within the module substrate 1.

In general, in the mm-wave band communication device, the electrical connection distance between the antenna and the wireless communication chip 3 is very important. That is, in the mm-wave band communication device, a radiation loss of the antenna is increased along with an increase in the distance between the antenna and the wireless communication chip 3, such that it is desirable that the wireless communication chip 3 and the antenna are disposed as close as possible to each other, and are electrically connected to each other.

Figure 6:
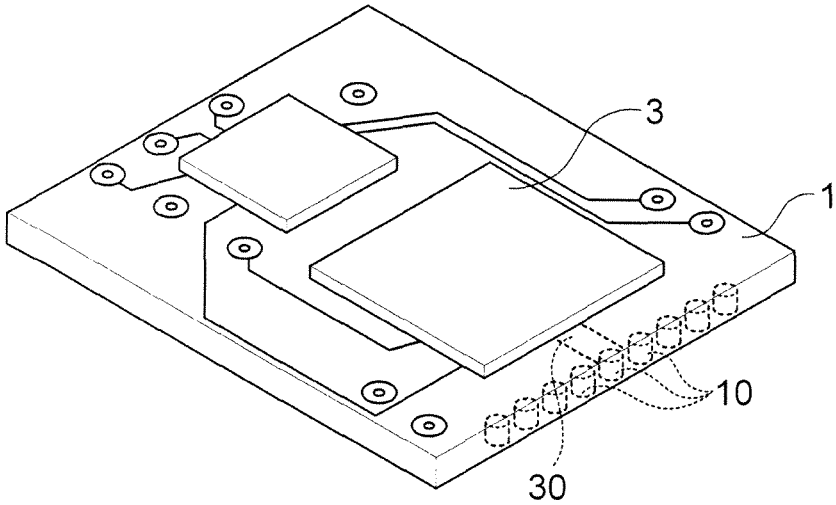
FIG. 6 is a schematic view illustrating a wireless communication module according to an exemplary embodiment of the present invention.

According to the present embodiment, the via patch part 10 may be embedded in the side portion of the module substrate 1, so that the distance between the wireless communication chip 3 and the antenna may be as short as possible when manufacturing the wireless communication module shown in FIG. 6.

Accordingly, by directly connecting with the wireless communication chip (IC) 3, the feed line part 30, which is a feeding portion of the antenna in the module substrate 1 in comparison with the method in the related art, minimizes the distance with the IC to improve an electrical loss.

In an example with reference to FIG. 2, a space (Sp) between the centers of the vias of the via patch part 10 has a relationship of $S_p<0.1\lambda_g$. Here, $\lambda_g$ denotes a wavelength in a dielectric of the module substrate 1.

In addition, in an example, a length (L) of the via of the via patch part 10 may be determined in accordance with a formula based on a length of a patch of a patch antenna.

In this instance, in an example, the length (L) of the via of the via patch part 10 may be determined by $$L=\frac{c}{2f\sqrt{e_f}}.$$

Here, c denotes the velocity of light in a free space, f denotes a resonance frequency, and $e_f$ denotes an effective dielectric constant of the module substrate 1.

In addition, referring to FIGS. 1 and/or 2, in another embodiment, the side-face radiation antenna may include a strip part 20. The strip part 20 may be formed in a strip shape, and formed at an upper side and a lower side of the plurality of vias of the via patch part 10 to mutually connect the metal filled in the via.

Next, referring to FIGS. 1, 2, 4, 5A and/or 5B, the feed line part 30 may be inserted between intermediate layers of the module substrate 1. In this instance, the feed line part 30 is connected to the via at the center portion of the via patch part 10.

Referring to FIGS. 1, 2, 4, 5A and/or 5B, the side-face radiation antenna according to another embodiment will be described. In the present embodiment, the side-face radiation antenna may include a ground part 40.

The ground part 40 may be spaced apart from the via patch part 10, and respectively formed at an upper side and a lower side of the module substrate 1. In addition, referring to FIGS. 1, 2, 4, 5A and/or 5B, the ground part 40 may be formed between layers of the module substrate, or an upper side or a lower side of the layers of the module substrate except for between the intermediate layers of the module substrate 1 in which the feed line part 30 is formed.

In addition, referring to FIGS. 1, 2, 4, 5A and/or 5B, in another embodiment, the ground part 40 may be respectively formed in an upper side and a lower side with respect to the feed line part 30. In this instance, the ground in the upper side, the lower side, or upper and lower sides with respect to the feed line part 30 may include a plurality of ground layers 40. In this instance, the plurality of ground layers may be connected to a metal through a via 41 formed on a substrate between layers. The reference numeral 41 is a via in which a metal for connecting the ground layer is filled.

Further, referring to FIG. 5B, in an example, the outermost layers of the ground part 40 may be spaced apart from each other in a vertical direction while being interposed between the via patch part 10 and a substrate layer.

FIG. 7A shows reflection coefficient characteristics of a side-face radiation antenna according to an embodiment of the present invention, and FIG. 7B shows radiation pattern results of a side-face radiation antenna according to an embodiment of the present invention.

In FIGS. 7A and 7B, a reflection coefficient and a radiation pattern of the side-face radiation antenna which is manufactured to satisfy that a via width is 0.1 mm, a via interval is 0.1 mm, a length of the via of the via patch part 10 is 0.5 mm, a width of the via patch part 10 is 1.3 mm are shown.

Referring to FIG. 7A, an antenna having a side-face radiation structure according to an embodiment has a minimized reflection loss in 60 GHz band to thereby be suitable for applications of a high-capacity transmission system which provides voice and image data services in mm-wave band communication devices.

In addition, it can be found that the radiation pattern of FIG. 7B is non-directionally radiated when viewed from the side. Thus, even though side-face radiation is performed, the side-face radiation antenna may have the same characteristics as those of the planar patch antenna.

Next, a wireless communication module according to a second embodiment of the present invention will be described in detail with reference to drawings. In this instance, the side-face radiation antennas according to the above described first embodiment, FIGS. 1 through 5B, and FIGS. 7A and 7B as well as FIG. 6 will be referred, and thus a repeated description will be omitted.

FIG. 6 is a schematic view illustrating a wireless communication module according to an exemplary embodiment of the present invention.

Referring to FIG. 6, a wireless communication module according to a second embodiment of the present invention may include a module substrate 1, a wireless communication chip 3, and a side-face radiation antenna.

In an example, the wireless communication module may be used in portable mobile devices.

The module substrate 1 of FIG. 6 is formed such that a plurality of substrates are laminated.

For example, the module substrate 1 may be a substrate using a laminated multi-layered substrate (LLC). In this instance, since the side-face radiation antenna according to the present embodiment is a patch antenna, a low dielectric constant may be effective, so that a hollow portion (not shown), and the like are formed in an LLC substrate that is generally a high dielectric constant, thereby reducing the dielectric constant.

For example, a hollow structure may be formed in an intermediate layer region of the module substrate 1 in which the feed line part 30 of the side-face radiation antenna is inserted.

The wireless communication module of FIG. 6 is embedded in the module substrate 1. In this instance, the wireless communication chip 3 may be electrically connected with the side-face radiation antenna through the feed line part 30.

In addition, in an example, the wireless communication module may be an mm-wave band communication module.

Next, the side-face radiation antenna may be formed in a side portion of the module substrate 1 to perform a side-face radiation. Detailed descriptions of the side-face radiation antenna has been described with reference to FIGS. 1 through 5B and the above described first embodiment, and thus repeated descriptions will be omitted.

In this instance, in an example, an end of the feed line part 30 of the side-face radiation antenna is electrically connected with the wireless communication chip 3.

According to the second embodiments of the present invention, the via patch part 10 of the side-face radiation antenna is embedded in the side portion of the module substrate 1, so that a distance between the wireless communication chip 3 and the antenna may be implemented as short as possible when manufacturing the wireless communication module. Accordingly, the feed line part 30 is directly connected with the wireless communication chip (IC) 3 in the module substrate 1, so that a distance with the IC may be minimized, thereby improving an electrical loss.

As set forth above, according to the embodiments of the present invention, there is provided the antenna having the side-face radiation structure which may achieve miniaturization and convenience so as to be applied to portable mobile devices.

In addition, according to an embodiment of the present invention, a space within a side portion of the module substrate is utilized to implement the antenna having the side-face radiation structure, thereby reducing a size of each of the antenna and the module.

In addition, according to an embodiment of the present invention, a short electrical connection distance between the antenna and the wireless communication chip may be provided, thereby improving a loss of the antenna.

In addition, according to an embodiment of the present invention, the side-face radiation structure may be adopted in comparison with the front-face radiation structure in the related art, thereby providing convenience and efficiency to portable mobile devices.

It is obvious that various effects directly stated according to various exemplary embodiment of the present invention may be derived by those skilled in the art from various configurations according to the exemplary embodiments of the present invention.

The accompanying drawings and the above-mentioned exemplary embodiments have been illustratively provided in order to assist in understanding of those skilled in the art to which the present invention pertains. In addition, the exemplary embodiments according to various combinations of the aforementioned configurations may be obviously implemented by those skilled in the art from the aforementioned detailed explanations. Therefore, various exemplary embodiments of the present invention may be implemented in modified forms without departing from an essential feature of the present invention. In addition, a scope of the present invention should be interpreted according to claims and includes various modifications, alterations, and equivalences made by those skilled in the art.

What is claimed is:

1. A side-face radiation antenna, comprising:

a via patch part formed at a side portion of a module substrate including laminated substrates to perform a side-face radiation, and formed by metal filled in a plurality of vias arranged at a predetermined interval in the side portion and connected; and a feed line part inserted between intermediate layers of the module substrate, and connected to the via at a center portion of the via patch part.

2. The side-face radiation antenna according to claim 1, further comprising:

a strip part formed in a strip shape, and formed at an upper side and a lower side of the plurality of vias of the via patch part to mutually connect the metal filled in the vias.

3. The side-face radiation antenna according to claim 1, wherein a space (Sp) between the centers of the plurality of vias of the via patch part has a relationship of $S_p<0.1\lambda_g$, where $\lambda_g$ denotes a wavelength within a dielectric of the module substrate.

4. The side-face radiation antenna according to claim 1, wherein a length (L) of each of the plurality of vias of the via patch part is determined in accordance with a formula based on a length of a patch of a patch antenna.

5. The side-face radiation antenna according to claim 4, wherein the length (L) of each of the plurality of vias of the via patch part is determined by $$L = \frac{c}{2f\sqrt{e_f}},$$

where c denotes the velocity of light in a free space, f denotes a resonance frequency, and $e_f$ denotes an effective dielectric constant of the module substrate.

6. The side-face radiation antenna according to claim 1, further comprising:

a ground part respectively formed at an upper side and a lower side of the module substrate while being spaced apart from the via patch part and formed between layers of the module substrate or an upper side or a lower side of the layers of the module substrate, except for between the intermediate layers of the module substrate in which the feed line part is formed.

7. The side-face radiation antenna according to claim 6, wherein the ground part is respectively formed at an upper side and a lower side with respect to the feed line part, a ground in the upper side or the lower side or grounds in the upper and lower sides with respect to the feed line part includes a plurality of ground layers, and the plurality of ground layers are connected to the metal through vias formed on the substrate between the layers.

8. The side-face radiation antenna according to claim 7, wherein the outermost layers of the ground part are spaced apart from each other in a vertical direction while the via patch part and a substrate layer being interposed therebetween.

9. The side-face radiation antenna according to claim 1, wherein the side-face radiation antenna exhibits characteristics of a planar patch antenna.

10. The side-face radiation antenna according to claim 3, wherein the side-face radiation antenna exhibits characteristics of a planar patch antenna.

11. The side-face radiation antenna according to claim 1, wherein the antenna is an mm-wave band antenna.

12. The side-face radiation antenna according to claim 3, wherein the antenna is an mm-wave band antenna.

13. A wireless communication module, comprising:

a module substrate formed such that a plurality of substrates are laminated;

a wireless communication chip mounted in the module substrate; and the side-face radiation antenna according to claim 1 which is formed in the module substrate.

14. A wireless communication module, comprising:

a module substrate formed such that a plurality of substrates are laminated;

a wireless communication chip mounted in the module substrate; and the side-face radiation antenna according to claim 2 which is formed in the module substrate.

15. A wireless communication module, comprising:

a module substrate formed such that a plurality of substrates are laminated;

a wireless communication chip mounted in the module substrate; and the side-face radiation antenna according to claim 3 which is formed in the module substrate.

16. A wireless communication module, comprising:

a module substrate formed such that a plurality of substrates are laminated;

a wireless communication chip mounted in the module substrate; and the side-face radiation antenna according to claim 5 which is formed in the module substrate.

17. A wireless communication module, comprising:

a module substrate formed such that a plurality of substrates are laminated;

a wireless communication chip mounted in the module substrate; and the side-face radiation antenna according to claim 6 which is formed in the module substrate.

18. The wireless communication module according to claim 13, wherein an end of a feed line part of the side-face radiation antenna is electrically connected with the wireless communication chip.

19. The wireless communication module according to claim 13, wherein the wireless communication module is an mm-wave band communication module.

20. The wireless communication module according to claim 13, wherein the wireless communication module is used in a portable mobile device.

* * * * *